US007082953B2

(12) United States Patent
Liu

(10) Patent No.: US 7,082,953 B2
(45) Date of Patent: Aug. 1, 2006

(54) UMBRELLA ACTUATOR

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 447 days.

(21) Appl. No.: 10/689,078

(22) Filed: Oct. 21, 2003

(65) Prior Publication Data

US 2005/0081902 A1 Apr. 21, 2005

(51) Int. Cl.
*A45B 25/06* (2006.01)

(52) U.S. Cl. ..... 135/38; 135/39; 135/41; 135/28

(58) Field of Classification Search ..... 135/28, 135/37–41
See application file for complete search history.

(56) References Cited

U.S. PATENT DOCUMENTS 1,202,063 A * 10/1916 Heyn ..... 135/41
2,528,002 A * 10/1950 Katzberg ..... 135/39
2,528,003 A * 10/1950 Katzberg ..... 135/39
3,424,180 A * 1/1969 Giancarlo ..... 135/28
5,632,290 A * 5/1997 Ling Kuo ..... 135/24
6,758,229 B1 * 7/2004 Wang ..... 135/41

FOREIGN PATENT DOCUMENTS

CH 621 691 * 2/1981

* cited by examiner

*Primary Examiner*—Robert Canfield

(74) *Attorney, Agent, or Firm*—Birch, Stewart, Kolasch & Birch LLP

(57) ABSTRACT

An umbrella actuator for extending and folding an umbrella includes a runner slidable on a vertical rod to drive an umbrella frame to move, an anchor element fixedly mounted on the vertical rod for latching the runner, and a coupling device attached to the runner including an annular ring which may be moved to anchor the runner on the vertical rod at an action position or be released thereby to achieve a safer and more reliable operation.

9 Claims, 5 Drawing Sheets

UMBRELLA ACTUATOR

FIELD OF THE INVENTION

The present invention relates to an umbrella actuator and particularly to the umbrella actuator that has a coupling device containing an annular ring for extending and folding an umbrella panel to enhance safety and reliability.

BACKGROUND OF THE INVENTION

Umbrella and parasol are widely used articles to protect people from getting wet in rainy day or suffering sunburn in sunny day.

In the earlier time, an umbrella rod and frame are made from tough and elastic bamboo. Strong cotton threads are wound on the frame, and paper impregnated with a selected oil is used as an umbrella panel. The impregnated panel can only fend off small rain. It is easily destroyed by strong wind or heavy rain. Hence it may look nicely, but has little practical value. Nowadays, a wide variety of umbrellas are available, such as folding umbrellas, parasols, and the like. They are not only designed with aesthetic appealing, also are tough and reliable. The folding umbrella is light and compact, and easy to carry. But it is easily damaged but strong wind and gale. The parasol generally is a special type of umbrella made in a larger size. The following mainly focuses on the design and application of the parasol.

Refer to FIG. 1 for a conventional large size parasol. It has a runner 12 movable on a vertical rod 11 to an action position and a departing position. The runner 12 serves as the pivot center of the frame 13. When the runner 12 is moved to the action position, the frame 13 will be driven to extend a panel 14. An anchor element 15 is provided on the vertical rod 11 at the action position. The anchor element 15 is a movable jutting member to keep the runner 12 at the action position and maintain the panel 14 at the extended condition. Basically it adopts the design of the folding umbrella without much difference. The main difference is the size and material. As the conventional large parasol is coupled through the runner 12 and anchor element 15, and there is no other means to firmly hold the runner 12, it is not very steady or reliable when in use. The anchor element 15 usually is a thin metal latch. When users try to extend the parasol, they have to grasp the runner 12 with one hand and hold the vertical rod 11 with another hand to move the runner in the axial direction to extend or collapse the panel 14. Moving the runner 12 tends to injure user's hands. Moreover, the anchor element 15 has a very small area to receive force. Thus folding the parasol is quite difficult and user's hands are easily hurt.

SUMMARY OF THE INVENTION

In view of the aforesaid disadvantages, the primary object of the invention is to provide an umbrella actuator that is safer and more reliable to facilitate use of the umbrella and protect users from injury.

The umbrella actuator according to the invention includes a runner, an anchor element and a coupling device. The anchor element is located on a vertical rod of the umbrella. The runner is slidable on the vertical rod for driving the frame to extend or fold. The coupling device is attached to the runner to anchor the runner at an action position when a panel is extended, or release the runner from the action position to fold the panel.

Another object of the invention is to provide an umbrella actuator that is labor saving during operation. The coupling device has a pushbutton to control the extension and folding of the panel. The pushbutton has a large area and may be depressed easily without hurting user's fingers.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
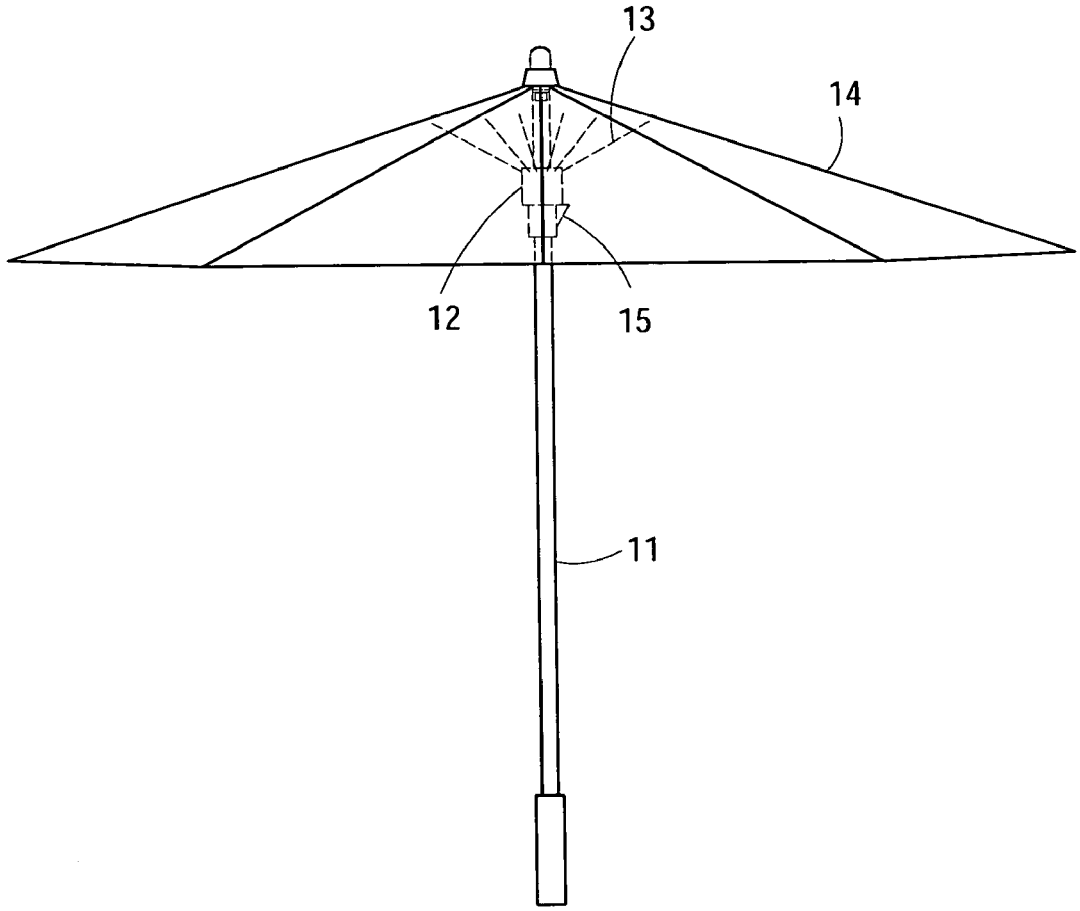
Fig.1 PRIOR ART
FIG. 1 is a perspective view of a conventional parasol.
Figure 2:
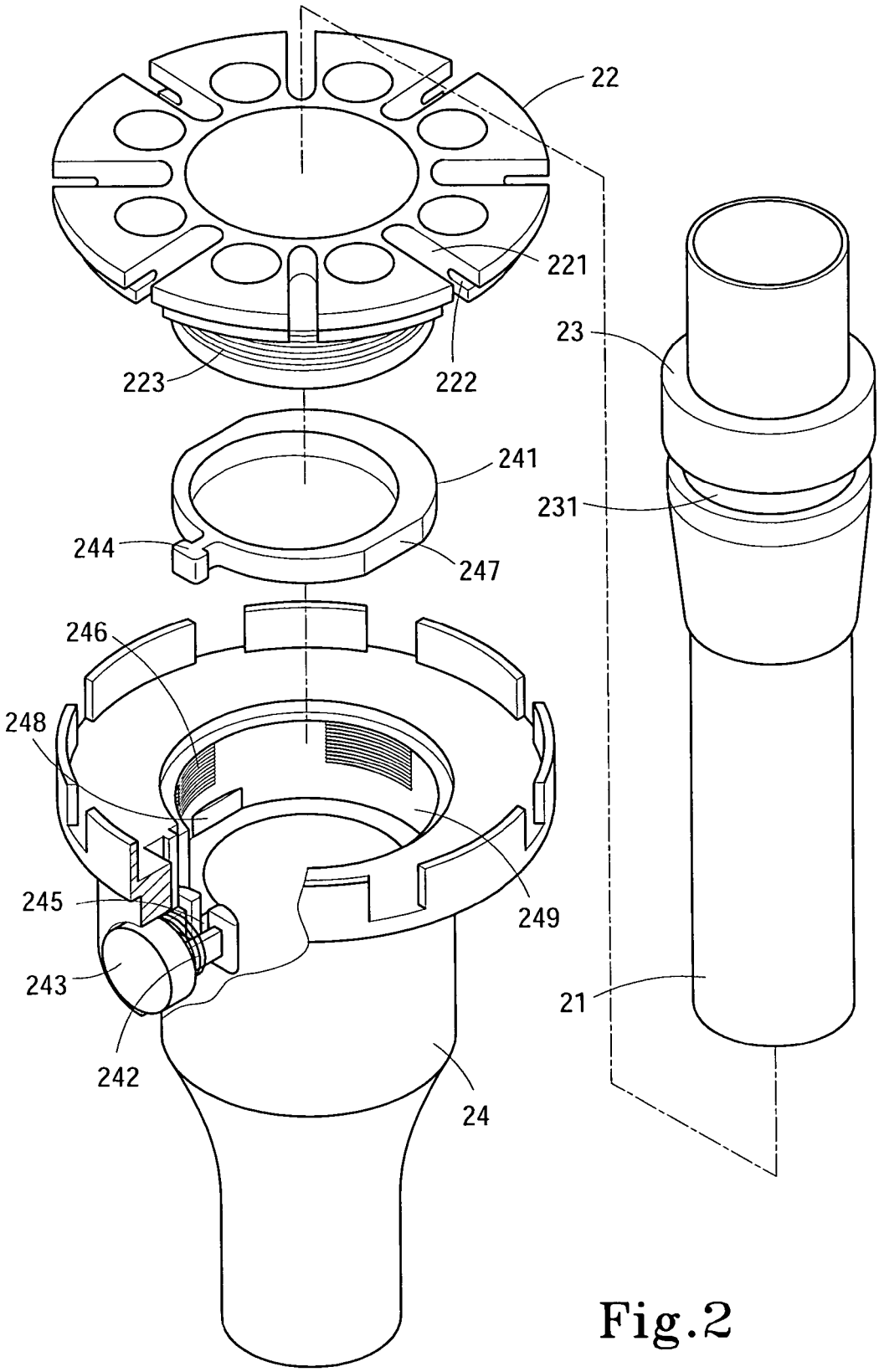
FIG. 2 is an exploded view of the present invention.
Figure 5:
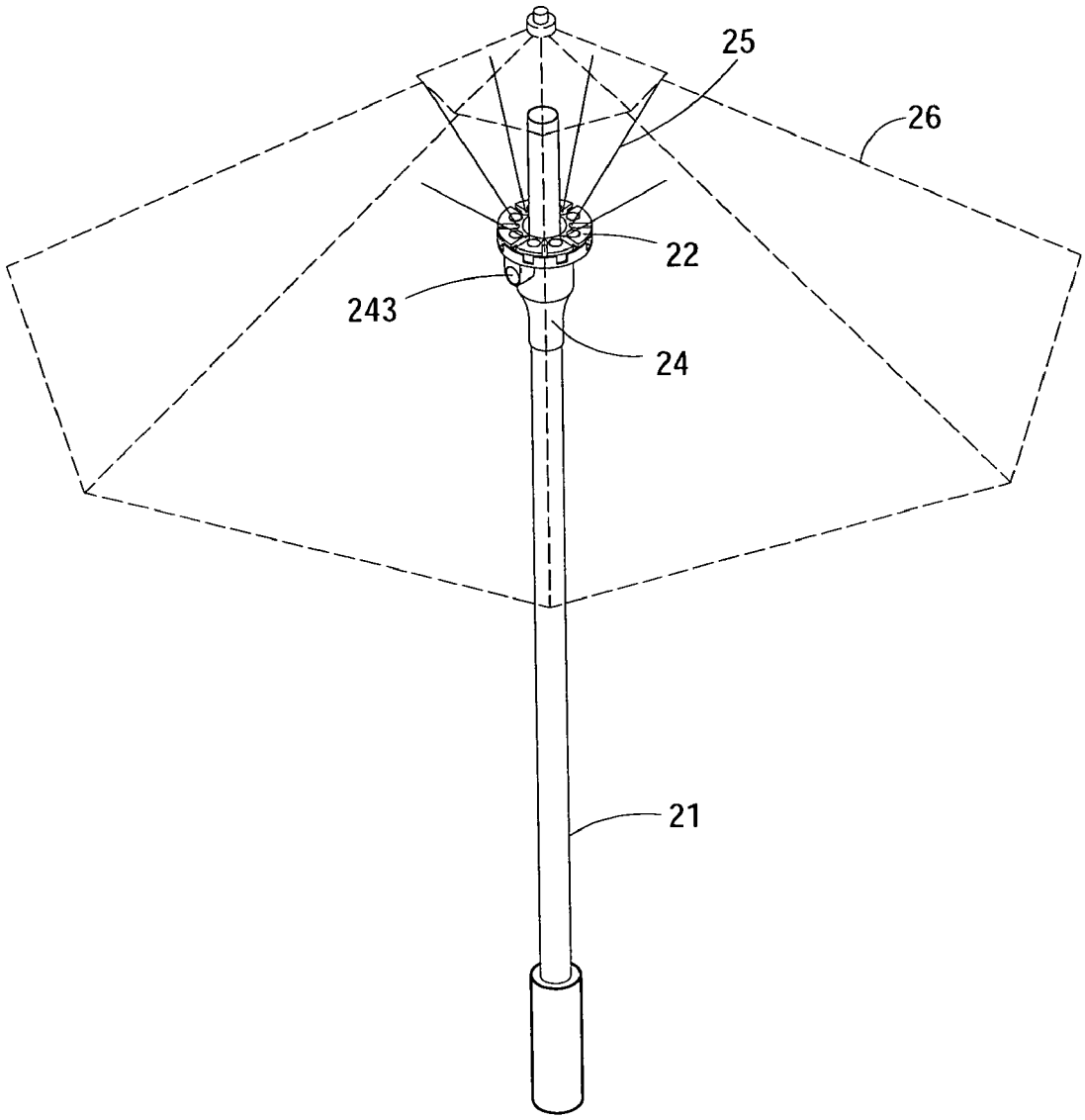
FIG. 5 is a schematic view of an embodiment of the invention.

Please referring to FIGS. 2 and 5, the umbrella actuator according to the invention includes:

a runner 22 slidable on a vertical rod 21 to serve as the pivot center of an umbrella frame 25. The runner 22 has notches 221 to couple with the frame and a trough 222 to receive a steel wire to anchor the frame 25 in the notches 221. The runner 22 may be moved axially on the vertical rod 21 to an action position and departed from the action position. When the runner 22 is moved to the action position, it drives the frame 25 pivotally engaged thereon to extend an umbrella panel 26.

an anchor element 23 fixedly mounted on the vertical rod 21 at a location corresponding to the action position of the runner 22. It has an indented groove 231, and a coupling device 24 which has a housing space 249. The housing space 249 has an inner wall forming internal screw threads 246. The runner 22 has a lower end forming external screw threads 223 which may be coupled with the internal screw threads 246 by turning clockwise. When the runner 22 reaches the action position, it may be anchored on the action position, or be released from the action position.

The coupling device 24 further has an annular ring 241, an elastic element 242 and a pushbutton 243. The annular ring 241 may be moved radially about the vertical rod 21. The annular ring 241 has a distal end forming a latch lug 244 to couple with a slot 245 formed on a distal end of the pushbutton 243. The annular ring 241 further has two tangent surfaces 247 on the outer perimeter mating and in contact with guiding surfaces 248 formed on an inner side of the coupling device 24 so that the annular ring 241 may be prevented from turning to the left and right side. In normal conditions, the annular ring 241 is pushed by the elastic element 242 to an eccentric position relative to the vertical rod 21 (the annular ring 241 is formed with the tangent surfaces 247 as the dividing spots, one end has a greater width than the other end to form the eccentric position) to couple with the groove 231 of the anchor element 23 to anchor the runner 22 on the action position. The annular ring 241 may also be moved away from the eccentric position by depressing the pushbutton 243 thereby release the runner 22 from the action position on the vertical rod 21.

Figure 3:
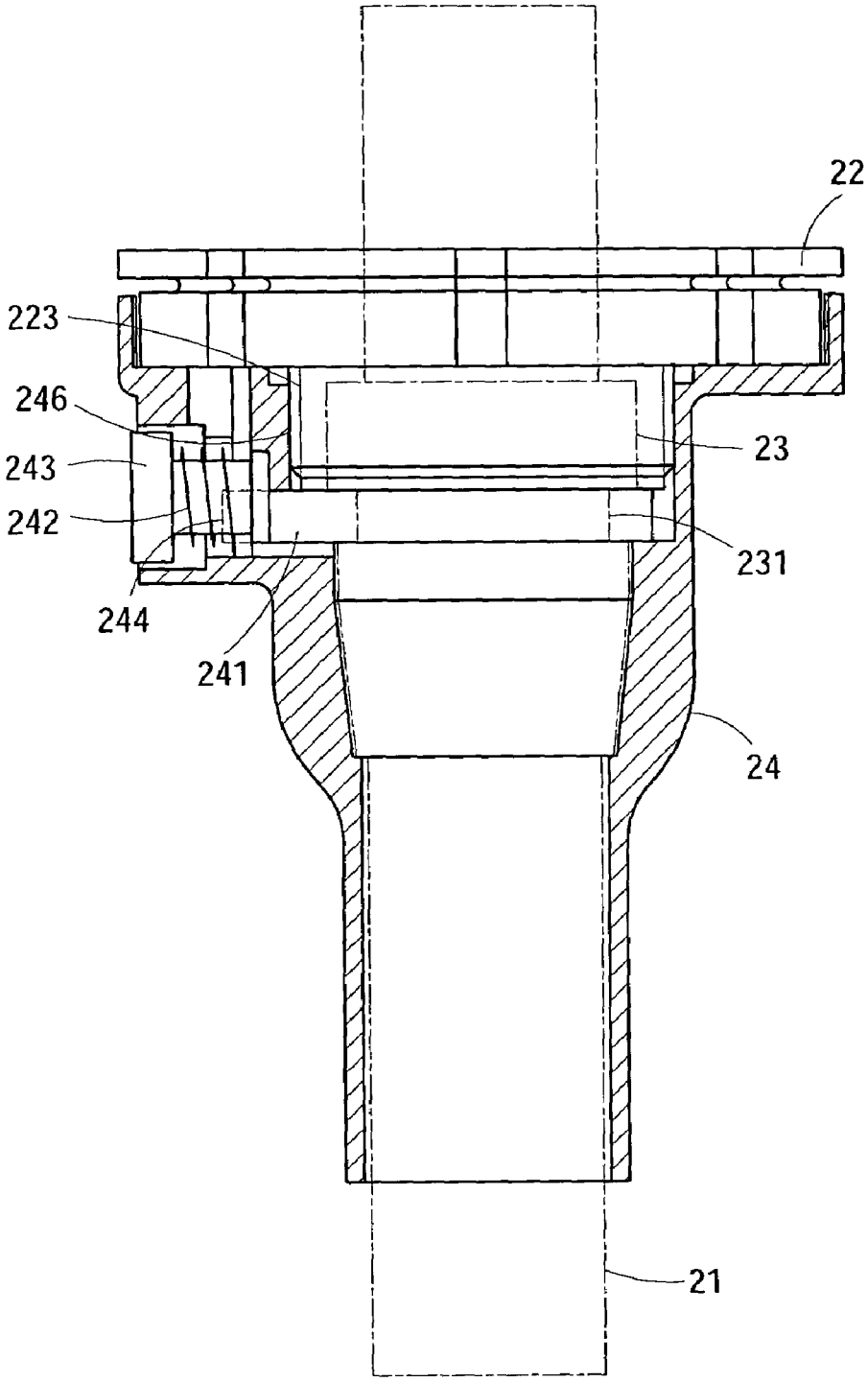
FIG. 3 is a sectional view of the present invention.

Referring to FIG. 3, the runner 22 is coupled with the coupling device 24. The anchor element 23 is fixedly mounted on the vertical rod 21 at a location corresponding to the action position of the runner 22. The coupling device 24 is latched on the anchor element 23. The anchor element 23 forms a conical and tapered shape below the groove 231. When the annular ring 241 is moved away from the eccentric position because of the pushbutton 243 is depressed against the elastic element 242, the coupling device 24 cannot be moved upwards axially on the vertical rod 21, but can be moved downwards axially along the conical and tapered portion and the vertical rod 21.

Figure 4A:
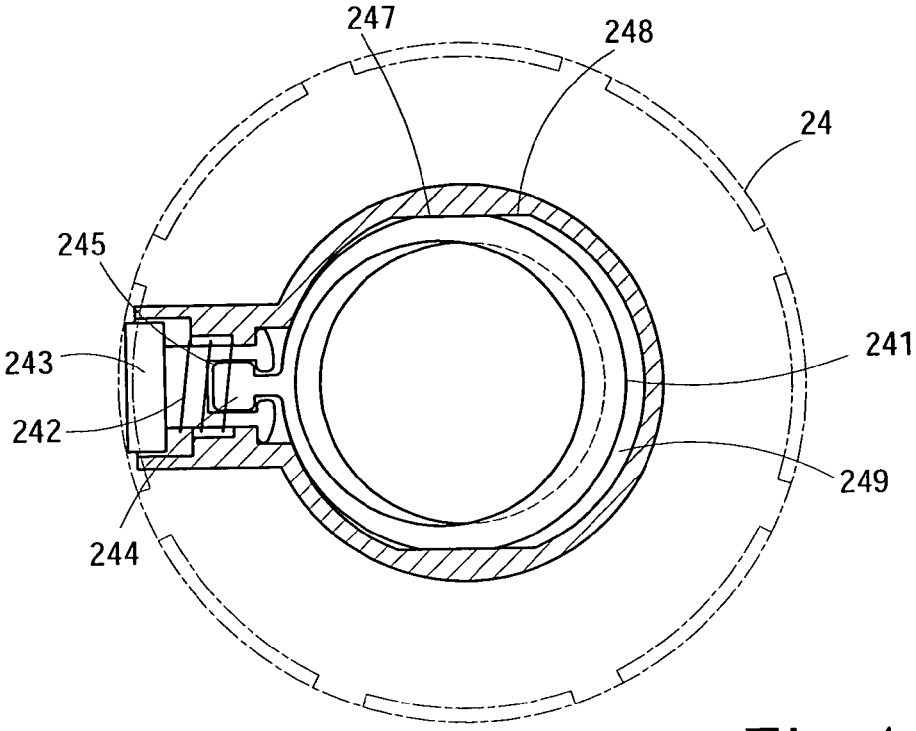
FIGS. 4A and 4B are schematic views of the present invention in operating conditions.
Figure 4B:
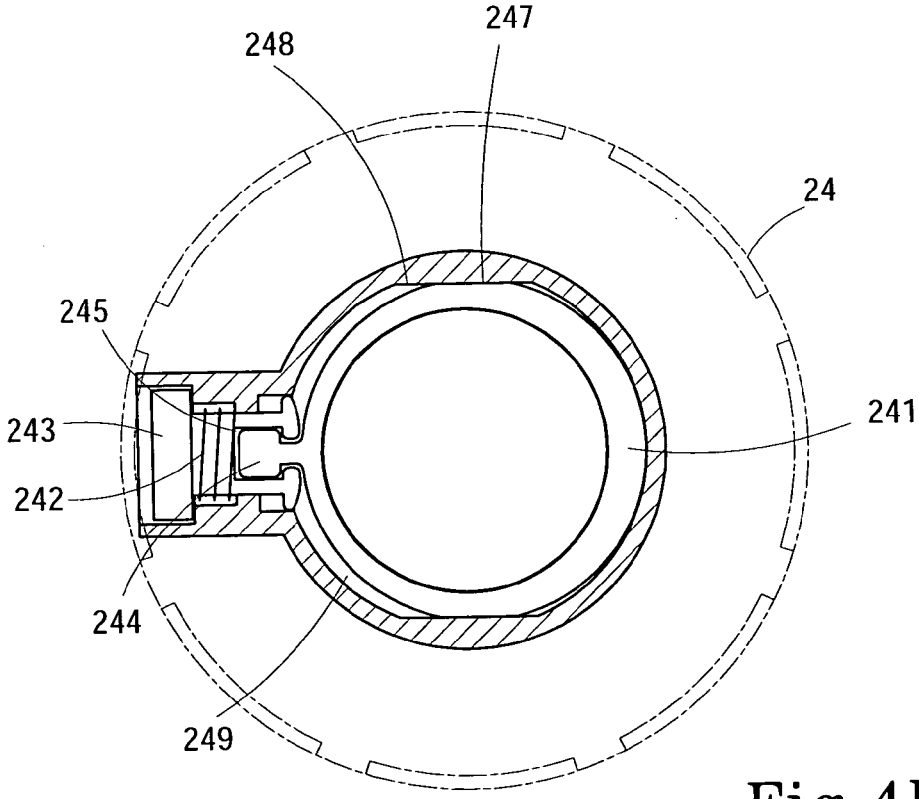

Referring to FIGS. 2, 4A and 4B, when the annular ring 241 is pushed by the elastic element 242 and moved radially about the vertical rod 21 to the eccentric position (as shown in FIG. 4A), it is anchored on the anchor element 23. On the other hand, when the pushbutton 243 is depressed and the annular ring 241 is moved away from the eccentric position (as shown in FIG. 4B), the runner 22 and the coupling device 24 are immediately separated from the anchor element 23.

Refer to FIGS. 2 and 5 for an embodiment of the invention that is adopted on a large parasol. The runner 22 is coupled with the coupling device 24, and is movable axially on the vertical rod 21. When it is moved to the action position, it is anchored on the anchor element 23, and the frame 25 pivotally coupled on the runner 22 is driven to extend the panel 26. By contrast, depressing the pushbutton 243 of the coupling device 24, the runner 22 may be moved away from the action position, and the frame 25 is retracted to fold the panel 26.

What is claimed is:

1. An umbrella actuator mounted on a vertical rod of an umbrella for controlling extension and folding of an umbrella frame and an umbrella panel, comprising:

a runner serving as a pivot center for said umbrella frame and being slidable on a vertical rod to an action position to extend said umbrella frame and said umbrella panel, and being movable away from said action position;

an anchor element mounted on said vertical rod at a location corresponding to said action position of said runner having an indented groove; and a coupling device attached to said runner for anchoring the runner on said action position or releasing said runner from said action position including an annular ring, an elastic element and a pushbutton, said annular ring being movable radially about said vertical rod, said annular ring being moved to an eccentric position relative to said vertical rod by said elastic element in normal conditions to couple with said groove of said anchor element to anchor said runner on said action position, and being movable away from said eccentric position by depressing said pushbutton to release said runner from said action position.

2. The umbrella actuator according to claim 1, wherein said runner is a tubular element, said vertical rod running through said axis of said tubular element.

3. The umbrella actuator according to claim 1, wherein said groove of the anchor element surrounds said vertical rod.

4. The umbrella actuator according to claim 1, wherein said anchor element is a tubular element and surrounds said vertical rod.

5. The umbrella actuator according to claim 1, wherein said anchor element is formed in a tapered and conical shape below said groove.

6. The umbrella actuator according to claim 1, wherein said annular ring has two rectangular planes on said periphery to latch a tubular inner wall of said coupling device.

7. The umbrella actuator according to claim 1, wherein said elastic element is a spring.

8. The umbrella actuator according to claim 1, wherein said runner has external screw threads, and said coupling device has internal screw threads.

9. The umbrella actuator according to claim 8, wherein said external screw threads are engageable with said internal screw threadsby turning clockwise.

* * * * *